United States Patent [19]

Rebel et al.

[11] Patent Number: 4,858,910

[45] Date of Patent: Aug. 22, 1989

[54] CONVEYOR FOR A SHEET-FED ROTARY PRESS

[75] Inventors: Herbert Rebel, Rodgau; Marco Bergmann, Offenbach/Main, both of Fed. Rep. of Germany

[73] Assignee: M.A.N. Roland Druckmaschinen, Fed. Rep. of Germany

[21] Appl. No.: 146,966

[22] Filed: Jan. 22, 1987

[30] Foreign Application Priority Data

Jan. 22, 1987 [DE] Fed. Rep. of Germany ..... 3701767

[51] Int. Cl.[4] ..... B65H 29/04

[52] U.S. Cl. ..... 271/204; 271/275; 271/277; 101/411

[58] Field of Search ..... 271/204, 205, 82, 277, 271/275; 101/408–410, 411, 246; 198/470.1, 803.7, 803.9

[56] References Cited

U.S. PATENT DOCUMENTS

| | | | |
|---|---|---|---|
| 3,334,897 | 8/1967 | Sharkey | 271/204 X |
| 4,202,268 | 5/1980 | Becker | 271/277 X |
| 4,241,659 | 12/1980 | Fischer | 271/82 X |
| 4,378,734 | 4/1983 | Wirz | 101/410 X |
| 4,413,562 | 11/1983 | Fischer | 271/277 X |

FOREIGN PATENT DOCUMENTS

| | | |
|---|---|---|
| 2017417 | 11/1971 | Fed. Rep. of Germany . |
| 2111049 | 9/1972 | Fed. Rep. of Germany . |

*Primary Examiner*—Joseph J. Rolla
*Assistant Examiner*—Nils E. Pedersen

[57] ABSTRACT

A conveyor for a sheet-fed rotary printing press for transferring sheets away from an impression cylinder includes a delivery cylinder disposed adjacent the impression cylinder, and a chain conveyor having a plurality of sheet grippers, adapted for moving the grippers about the delivery cylinder for successively engaging sheets on the impression cylinder. The delivery cylinder has a gap in its outer periphery for receiving successive of the sheet grippers during transfer of a sheet from the impression cylinder to the sheet grippers. The sheet grippers each include a support and a pivotable gripper finger, and a displacer mounted on and extending rearwardly of each gripper support for bridging the gap in the delivery cylinder within which the gripper is disposed during a sheet transfer operation, and for maintaining tension in the sheet during transfer from the impression cylinder to the chain conveyor. The displacer is comb shaped having a plurality of rearwardly extending arcute shaped teeth. A sheet support comb also may be supported on the delivery cylinder with its teeth forwardly extending in intermeshing relation with the teeth of the displacer so as to completely bridge the gap within which the sheet gripper is disposed. Antismear rollers or like elements may be disposed on the teeth of the displacer and the sheet support comb to facilitate smooth transfer of the sheet away from the compression cylinder.

17 Claims, 4 Drawing Sheets

CONVEYOR FOR A SHEET-FED ROTARY PRESS

DESCRIPTION OF THE INVENTION

The present invention relates generally to sheet transfer conveyors for sheet-fed rotary printing presses, and more particularly, to chain conveyors which have a plurality of sheet gripper carrying trolleys adapted for successively engaging sheets from grippers on a cylinder, such as an impression cylinder of a printing press, and transferring the sheets away from the cylinder to the next printing unit or to a sheet delivery unit.

Chain type of sheet transfer conveyors are known in the art, as depicted, for example, in German Patent No. DE-PS 2 111 049. Conveyors of this type comprise a pair of endless chains that are trained around reversing and drive sprockets and carry plurality of trolleys, each having a sheet gripper comprising a support or pad and pivotably mounted gripping fingers adapted for engaging a sheet and securing it against the gripper support. The gripper supports typically project beyond the pitch circle diameter of the reversing sprockets around which the conveyor chains run near the place of transfer of the sheets from the impression cylinder of the press to the conveyor. During a sheet transfer operation, the gripper supports of the trolleys travel on a radius about its sprocket which is substantially equal to the radius of the gripper supports of the grippers on the impression cylinder. The supports of the grippers thereby move faster during the sheet transfer than the speed the chains travel around the reversing sprockets. When the gripper trolley carrying portions of the chains disengage from the reversing sprockets and move substantially linearly away from the reversing sprockets, the speed of the grippers decreases to chain speed. However, the rear end of the sheet may not by this time have left the impression cylinder, and therefore, is being advanced faster than the front end of the sheet being transferred by the chain conveyor. The sheet therefore ceases to be tensioned and waves may form in the sheet, with a high risk of set off. Also, the sheet will be retained on the blanket cylinder that cooperates with the impression cylinder until it is pulled away, the force of which sometimes can cause permanent defermation in the sheet. To obviate these disadvantages, it is known from German Patent No. DE PS 2 111 049 to press a sheet displacer onto the sheet in order to maintain tension therein after transfer of the sheet to the grippers of the chain conveyor.

A disadvantage of such devices is that the displacer sets off the sheet and is not operative on the sheet immediately after the transfer to the conveyor grippers. Since the chain conveyor grippers typically run within recesses in a delivery cylinder disposed immediately adjacent the press cylinder from which the sheet is to be received, a considerable space may exist between the gripper and the front or leading edge of the delivery cylinder adjacent the recess. Hence, the leading portion of the sheet to some extent is disposed over a non-supporting zone of the delivery cylinder above the recess and can experience bending before it is acted upon by the displacer. Conventional displacers, therefore, cannot maintain tension on the sheet at the beginning of the sheet transfer operation to the chain conveyor.

It is known to provide a forced air directing sheet displacer in the recess or gap between the sheet grippers and the forward edge of the delivery cylinder over which the sheet is directed during the transfer operation. Such system is shown in German Patent No. DE PS 2 017 417. The air cushion formed by air blower displayers, however, generally is insufficient to prevent bending of the sheet when the sheet experiences extremely high forces, for example, in the case of double printing units, and when relatively large recesses or gaps are provided in the delivery cylinder, such as are necessary for the accommodation of stable gripper systems which are secured to the conveyor trains with associated gripper trolleys. Moreover, the air blower in such arrangements rotate with the delivery cylinder, and as a result, is operative only in the vicinity thereof. Furthermore, in sheet transfer systems, the sheets need to be supported after the chain carrying grippers have left the reversing sprockets of the delivery cylinder in order to insure flutter-free entry of the sheet into the next printing unit or to the sheet delivery unit. Still a further disadvantage of such air blower displacers is that they require the expense and complexity of an air supply and control.

It is an object of the present invention to provide a sheet transfer conveyor with a mechanical sheet displacer adapted to more effectively guide the printed sheet, with reduced risk of set off, immediately after transfer from the impression cylinder to the grippers of the sheet transfer conveyor and for maintaining sufficient tension in the sheet until the sheet is released by the grippers of the chain at the next transfer station.

Another object is to provide a sheet transfer conveyor as characterized above that is relatively simple in construction and lends itself to economical manufacture and reliable operation.

Other objects and advantages of the invention will become apparent upon reading the following detailed description and upon reference to the drawings, in which.

Figure 1:
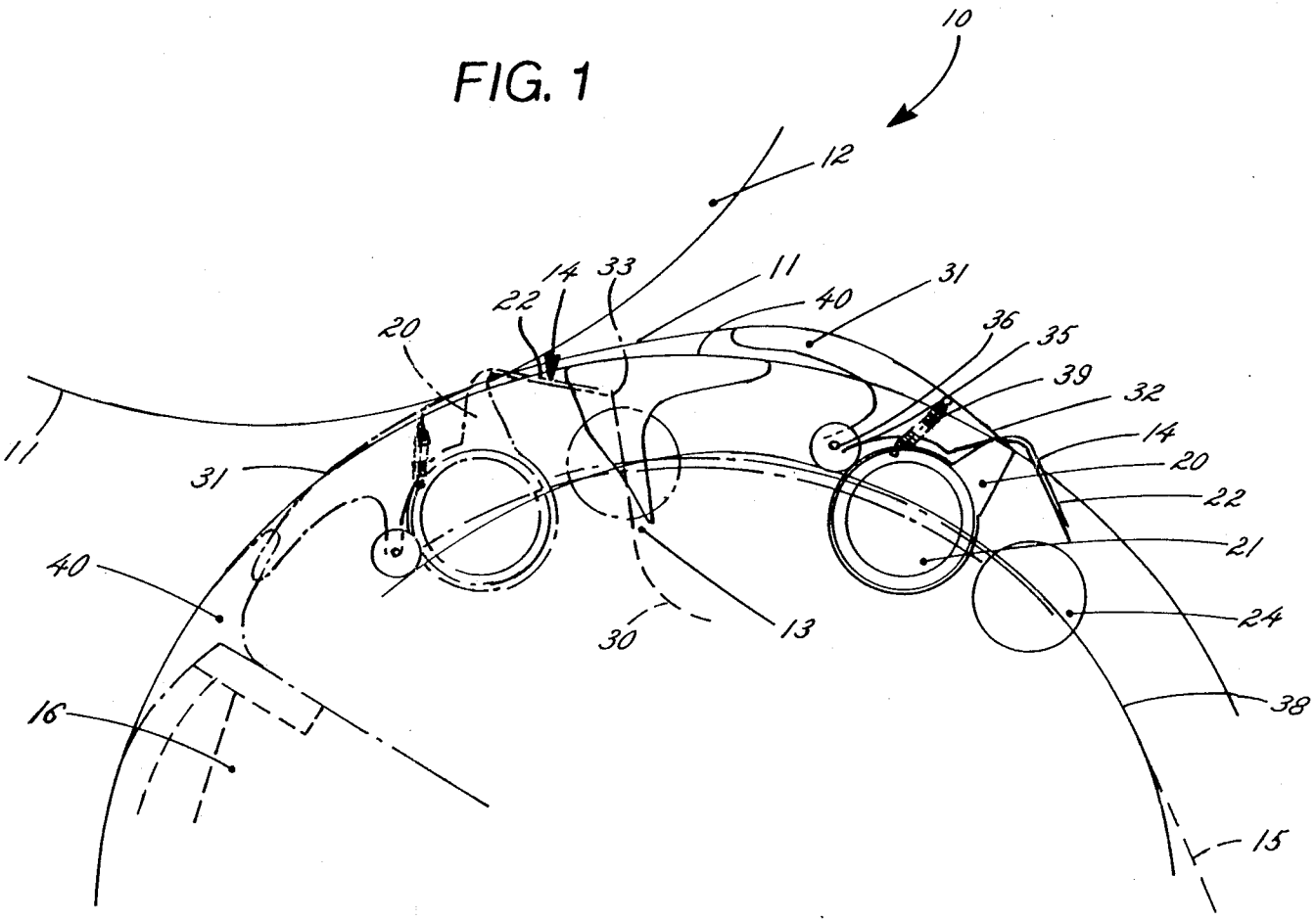
FIG. 1 is a diagrammatic side elevation view of a sheet transfer system which includes a sheet displacer embodying the present invention.

While the invention is susceptible of various modifications and alternative constructions, certain illustrated embodiments thereof has been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

Figure 2:
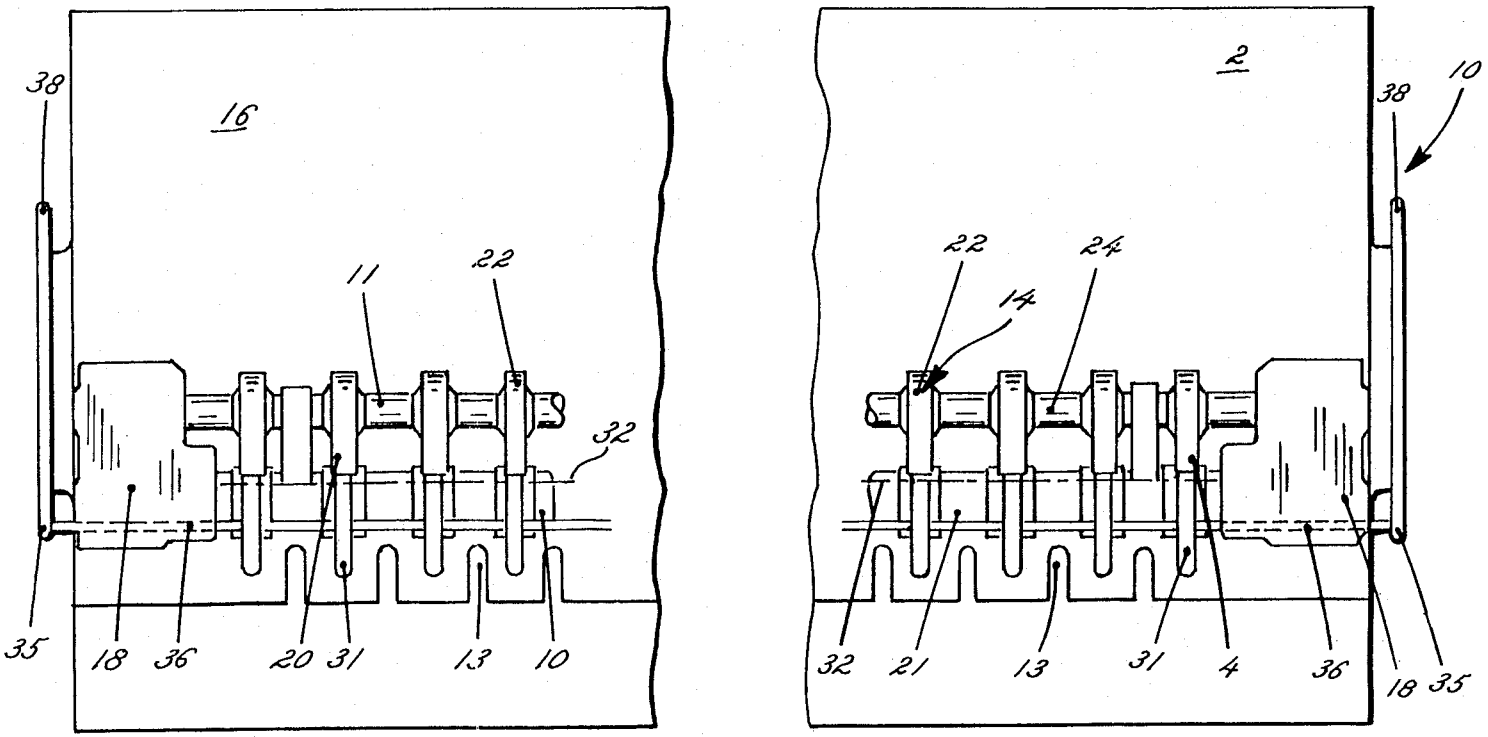
FIG. 2 is a plan view of the sheet displacer shown in FIG. 1.

Referring now more particularly to FIGS. 1 and 2 of the drawings, there is shown an illustrative sheet transfer apparatus 10 embodying the invention adapted for successively receiving sheets 11 from a cylinder 12 of a printing press, such as an impression cylinder, and transferring the sheets to the next printing unit or to a sheet delivery unit. It will be understood that the impression cylinder 12 is provided with conventional sets of grippers (not shown) which are adapted to engage leading edges of sheets directed onto the impression cylinder and which are sychronized to release the sheet in timed operation to the sheet transfer apparatus 10.

The sheet transfer apparatus 10 includes sheet grippers 14 mounted on a pair of chains 15 which are driven about sprockets in a conventional manner, including sprockets located on opposite sides of a delivery cylinder 16 disposed immediately adjacent the impression cylinder 12. The sheet grippers 14 each are supported on trolleys 18 which in turn are coupled to the chains at their outer sides such that the trolleys 18 and grippers 14 are drawn along with movement of the chains. The grippers 14 each include a pad or support 20 which is mounted on a spindle 21 supported between the trolleys 18, and axially spaced gripper fingers 22 mounted on a gripper shaft 24 are adapted for pivotal or rocking movement. The gripper fingers 22 can thereby be pivotably rocked in a conventional manner by rotation of the gripper shaft 24 for engaging and releasing a sheet 11 against the support 20, such shaft rotation being effected by appropriate cammed control means in a known manner.

During the sheet transfer operation, the gripper 14 is disposed in a respective gap or recess 30 in the delivery cylinder 16. Depending upon the flowability of ink during the printing operation, the surface texture of the blanket and plate cylinders used in association with the impression cylinder 12, and the manner of sheet movement, heretofore the sheets have had a tendancy to bend into the gap 30 as the sheet moves onto the delivery cylinder 16, with a risk of set off of the printed sheet unless the leading portion of the sheet is prevented from being drawn into the gap of the delivery cylinder.

In accordance with the present invention, displacer means are provided on each gripper for bridging the gap in the delivery cylinder within which the gripper is located and for maintaining tension on the sheet during the transfer operation. To this end, in the embodiment illustrated in FIGS. 1 and 2, the gripper support 20 of each gripper 14 has a displacer 31 extending rearwardly thereof for bridging the gap 30 in the delivery cylinder 16 within which the gripper is disposed. The displacer 31 has a curved outer bearing surface which is substantially the same radius as the periphery of the delivery cylinder 16. The displacer 31 in this instance is in the form of a comb comprising a plurality o rearwardly extending arcuately shaped teeth located at axially spaced intervals across the delivery cylinder. It will be understood that the gripper support 20 and the displacer 31 can be mounted for radial adjustability in order to compensate for differences between the outer peripheral sheet carrying surface of the delivery cylinder 16 and the support 20, and thereby, compensate for differences in the thickness of sheets being processed.

In keeping with the invention, the displacer 31 is radially movable outside the radius of the chain for preventing a sheet during its transfer to the conveyor grippers 14 from bending into the gap 30 in the delivery cylinder and for maintaining the sheet in a state of tension. The displacer 31 in this instance has a forward portion pivotably mounted on a cross member 32 which in turn is mounted for pivotal movement with respect to the trolleys 18. For pivoting the displacer 31 between a position in which the teeth thereof are substantially in the plane of the delivery cylinder to a position in which the teeth extend outwardly thereof, as shown in FIG. 1, rollers 35 are secured at opposed ends of a cross section 36 which support the displacer 31. The rollers, being disposed in opposite sides of the delivery cylinder 16, are biased into engagment with operating cams 38 by springs 39. Hence, the displacer can be sequentially displaced by cam actuation out of the radius of the chain of the sprockets, and after the end of the sheet has left the printing zone, pivoted back again. The slow down of the grippers that occurs when the grippers leave the reversing sprockets and start to proceed linearly along with the chain can thereby be compensated for until the sheet has left the printing zone. Waviness of the sheet is therefore obviated and the risk of set off reduced. Also, the sheet is prevented from being carried along with a blanket cylinder which is operating in association with the impression cylinder, particularly toward the end of the sheet, so as to prevent the sheet from being torn at such location. Tear strips and other markings in the print are also obviated.

In order to completely bridge the gap 30 between the grippers 14 and the front edge 33 of the gap 30 of the delivery cylinder 16, beginning at the start of the sheet upon the transfer thereof from the impression cylinder to the grippers, a sheet support comb 40 is provided adjacent the leading edge of the gap in the delivery cylinder and has forwardly extending fingers designed to mesh with the fingers of the displacer 31. Such comb arrangement insures that the displacer surfaces and the surfaces of the sheet support comb 40 do not collide when the grippers enter the cylinder 16 and when they leave.

From the foregoing, it can be seen that after the gripper carrying portion of the chains leave the reversing sprocket adjacent the delivery cylinder 16 and are continuing their movement rectalinearly, the start of the sheet 11 continues to lie flush on the curved bearing surface of the displacer 31, thus insuring that the sheet is guided without smearing and flutter until it disengages from the grippers in the next printing unit or in the sheet delivery unit. The displacer 31 further maintains a uniform tension to be exerted on the sheet by virtue of the displacement throughout the sheet transfer operation, thus obviating the risk of set off of the front edge of the sheet in the delivery cylinder. Such tension can be maintained by controlling the sheet displacer so that it moves out of the chain radius when the leading edge of the sheet is moving slowly along the straight path of the sprockets and the trailing end of the sheet end is moving faster while still in the printing zone. Also, no additional steps are needed to insure that the sheet, in its further conveyance until displacement from the grippers upon transfer to the next printing unit or to the delivery unit, always engages flush with the curved support surfaces of the displacer 31, without flutter and without set off over the entire period of its travel.

Figure 3:
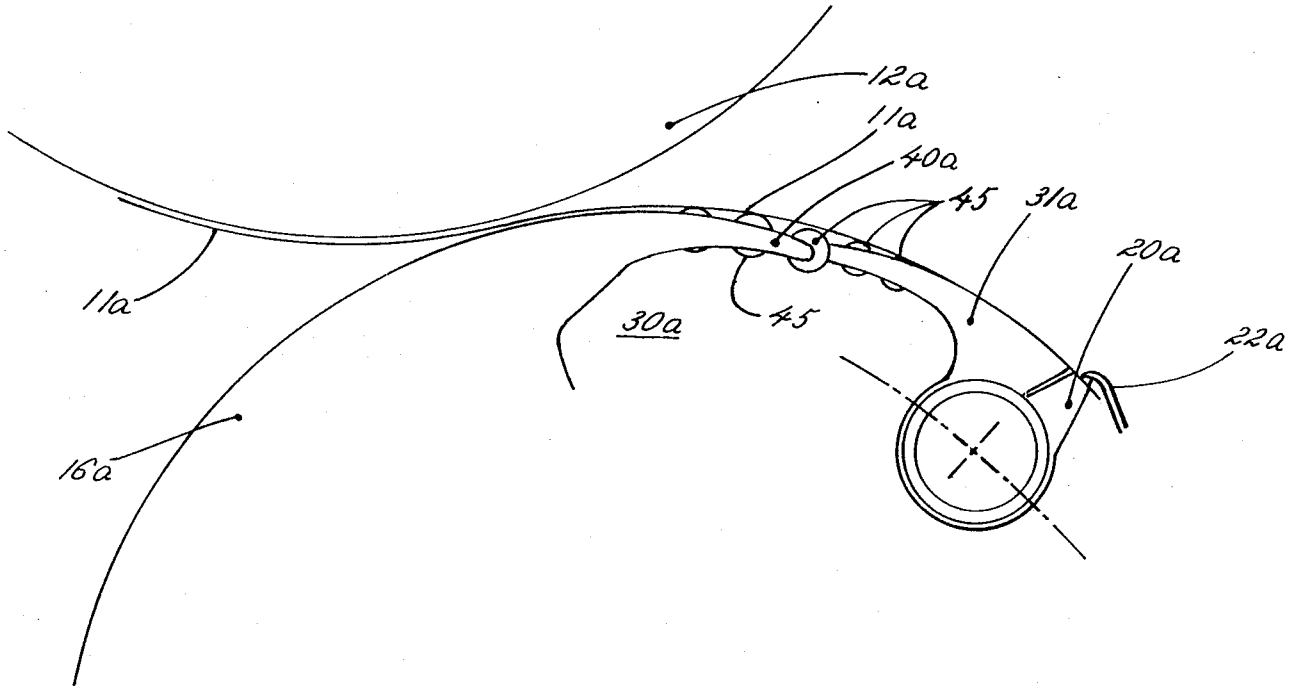
FIG. 3 is a diagrammatic view, in side elevation, of an alternative embodiment of sheet displacer according to the invention.

Referring now to FIG. 3, there is shown a sheet transfer conveyer apparatus 10a with an alternative form of displacer **31*a***, wherein parts similar to those described above have been given similar reference numerals with the distinguishing "*a* " added. In this embodiment anti-smear guidance means are provided on both the displacer **31*a* and the sheet support comb 40*a* to further facilitate the transfer operation without adversely affecting the printed matter. In this embodiment, anti-smear elements provided 45, such as rolls are provided between the fingers of both the displacer 31*a* and the sheet support comb 40*a***. It will be appreciated that any known comparable anti-smear elements, such as sheet guiding rings, special surface coatings, knubs, coverings with super-blue, glass beads, or other coverings, could be used. Blown air or the like could also be employed, but is not essential.

Figure 4:
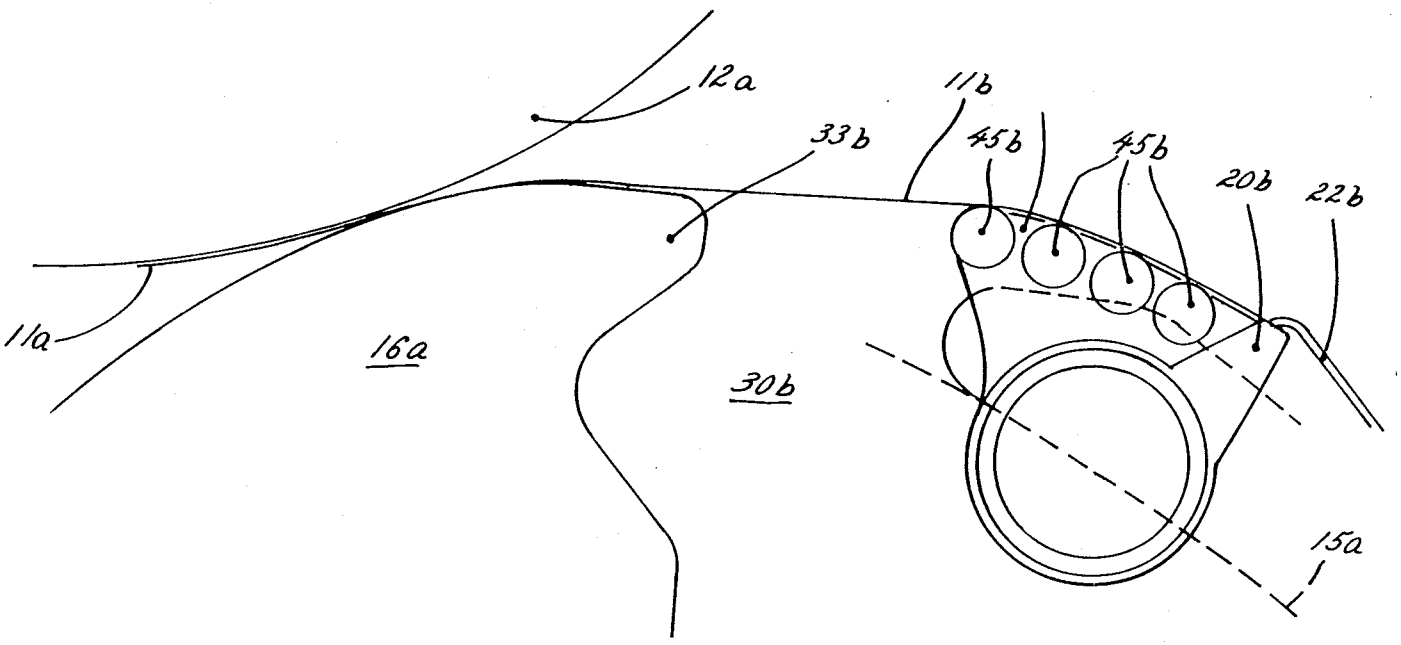
FIG. 4 is a diagrammatic view, in side elevation, of another alternative embodiment of sheet displacer according to the invention.

Referring now to FIG. 4, there is shown a sheet transfer conveyor apparatus 10*b* with another alternative embodiment of displacer 31*b* wherein items similar to those described above have been given similar reference numerals with the distinguishing "*b* " added. In this instance, the displacer 31*b* is fixedly mounted on the grippers support 20*b* and extends rearwardly thereof so as to bridge a substantial portion of the gap 30*b*, but not the entire gap. Anti-smear rollers 45*b* are provided to facilitate the sheet transfer. Alternatively, the displacer 31*b* could be mounted for radial movement with respect to the radius of the chain sprocket, as previously described. Moreover, while the displacers 31, 31*a*, 31*b* have been shown as comb shaped members with a plurality of rearwardly extending finger portions, alternatively, the displacers could have an uninterrupted sheet receiving surface.

We claim as our invention:

1. A conveyor for a sheet-fed rotary printing press for transferring sheets away from an impression cylinder comprising a delivery cylinder disposed adjacent said impression cylinder, a chain conveyor having a plurality of sheet grippers adapted for moving said grippers about said delivery cylinder for successively engaging sheets on said impression cylinder, said delivery cylinder having a gap in the outer periphery thereof for receiving successive of said sheet grippers during transfer of a sheet from said impression cylinder to said sheet grippers, said sheet grippers each including a support and a pivotable gripper fringer for engaging the leading edge of a sheet against said support during a sheet transfer operation, and displacer means disposed on each gripper support for bridging the gap in said delivery cylinder within which the gripper is disposed during a sheet transfer operation.

2. The sheet transfer conveyor of claim 1 in which said displacer means bridges the entire gap within which said sheet gripper is disposed during a sheet transfer operation.

3. The sheet transfer conveyor of claim 1 in which said displacer bridges a substantial portion of said gap within which said sheet gripper is disposed during a sheet transfer operation.

4. The sheet transfer conveyor of claim 1 in which said displacer is comb shaped having a plurality of rearwardly extending and transversely spaced teeth.

5. The sheet transfer conveyor of claim 4 in which said teeth have an arcuate shape.

6. The sheet transfer conveyor of claim 1 in which said displacer is radially movable with respect to said gripper support for maintaining tension in said sheet during said sheet transfer operation.

7. The sheet transfer conveyor of claim 6 in which said displacer is mounted for pivotable movement relative to said gripper support.

8. The sheet transfer conveyor of claim 4 including a sheet support element mounted on said delivery cylinder and extending forwardly over said gap, and said sheet support member having a plurality of teeth adapted for intermeshing positioning with respect to the teeth of said displacer so that said gap is completely bridged during transfer of a sheet from said impression cylinder to said chain conveyor.

9. The sheet transfer conveyor of claim 1 in which said displacer carries rollers for inhibiting set off and smearing of sheets during transfer.

10. The sheet transfer conveyor of claim 8 in which said sheet support and displacer each have rollers for inhibiting set off and smearing of sheets during transfer.

11. A conveyor for a sheet-fed rotary printing press for transferring sheets away from an impression cylinder comprising a delivery cylinder disposed adjacent said impression cylinder, a chain conveyor having a plurality of sheet grippers adapted for moving said grippers about said delivery cylinder for successively engaging sheets on said impression cylinder, said delivery cylinder having a gap in the outer periphery thereof for receiving successive of said sheet grippers during transfer of a sheet from said impression cylinder to said sheet grippers, said sheet grippers each including a support and a pivotable gripper fringer for engaging the leading edge of a sheet against said support during a sheet transfer operation, and displacer means mounted on and extending rearwardly of each gripper support for bridging the gap in said delivery cylinder within which the gripper is disposed during a sheet transfer operation and for maintaining tension in said sheet during a sheet transfer operation.

12. The sheet transfer conveyor of claim 11 in which said displacer is comb shaped having a plurality of rearwardly extending and transversely spaced teeth.

13. The sheet transfer conveyor of claim 12 in which said teeth have an arcuate shape.

14. The sheet transfer conveyor of claim 11 in which said displacer is radially movable with respect to said gripper support for displacing the sheet to maintain the sheet in tension.

15. The sheet transfer conveyor of claim 14 in which said displacer is mounted for pivotable movement relative to said gripper support.

16. The sheet transfer conveyor of claim 13 including a sheet support element mounted on said delivery cylinder and extending forwardly over said gap, and said hemet support member having a plurality of teeth adapted for intermeshing positioning with respect to the teeth of said displacer so that said gap is completely bridged during transfer of a sheet from said impression cylinder to said chain conveyor.

17. The sheet transfer conveyor of claim 16 in which said sheet support and displacer each have rollers for inhibiting set off and smearing of sheets during transfer.

* * * * *